US009511589B2

(12) United States Patent
Ohnishi

(10) Patent No.: US 9,511,589 B2
(45) Date of Patent: Dec. 6, 2016

(54) INK JET PRINTER

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/571,307

(22) Filed: Dec. 16, 2014

(65) Prior Publication Data

US 2015/0191019 A1 Jul. 9, 2015

(30) Foreign Application Priority Data

Jan. 6, 2014 (JP) ..... 2014-000524

(51) Int. Cl.
*B41J 2/165* (2006.01)
*B41J 2/21* (2006.01)
*B41J 2/045* (2006.01)

(52) U.S. Cl.
CPC ..... *B41J 2/16579* (2013.01); *B41J 2/2142* (2013.01); *B41J 2/0451* (2013.01); *B41J 2/04561* (2013.01)

(58) Field of Classification Search
CPC ... B41J 2/16579; B41J 2/04561; B41J 2/2142; B41J 2/0451
See application file for complete search history.

(56) References Cited

U.S. PATENT DOCUMENTS

2001/0003458 A1* 6/2001 Shioya ..... 347/19
2002/0140756 A1* 10/2002 Kuriyama et al. ..... 347/19
2003/0142161 A1* 7/2003 Miura et al. ..... 347/19
2005/0046658 A1* 3/2005 Kojima ..... 347/19
2006/0158477 A1* 7/2006 Kusakari et al. ..... 347/19
2006/0256153 A1* 11/2006 Arakawa ..... 347/19
2006/0268035 A1* 11/2006 Lee et al. ..... 347/12
2012/0139982 A1* 6/2012 Abe ..... 347/14
2012/0223997 A1* 9/2012 Abe ..... 347/19
2014/0098156 A1* 4/2014 Taff ..... B41J 2/04561 347/19

FOREIGN PATENT DOCUMENTS

JP 3507340 3/2004

OTHER PUBLICATIONS

"First Office Action of China Counterpart Application", issued on Jan. 7, 2016, pp. 1-16, with English translation tereof.

* cited by examiner

*Primary Examiner* — Stephen Meier
*Assistant Examiner* — John P Zimmermann
(74) *Attorney, Agent, or Firm* — Jianq Chyun IP Office

(57) ABSTRACT

An ink jet printer is provided with an ink jet head in which a nozzle for discharging an ink droplet toward a print medium is formed, a light emitting section that emits light for detecting the flying ink droplet that was discharged from the nozzle, and a light receiving section that receives the light emitted by the light emitting section are provided; detects the ink droplet in a case where an amount of the light received by the light receiving section among the light emitted by the light emitting section is equal to or less than a predetermined amount; and determines that a nozzle is defective (S167) in a case where the ink droplet discharged from the nozzle based on print data in the printing by the ink jet head is not detected at a scheduled timing of passing through a detection region (YES in S163 and YES in S164).

10 Claims, 20 Drawing Sheets

64a Detection target position information

| x | y |
|---|---|
| 1 | 1 |
| 1 | 2 |
| 1 | 3 |
| 2 | 4 |
| 2 | 5 |
| 2 | 6 |
| 3 | 7 |
| 3 | 8 |
| 3 | 9 |
| 4 | 10 |
| 4 | 11 |
| 4 | 12 |
| 5 | 13 |
| 5 | 14 |
| 5 | 15 |
| 6 | 16 |
| 6 | 17 |
| 6 | 18 |
| 7 | 19 |
| 7 | 20 |
| 7 | 21 |
| 8 | 22 |
| 8 | 23 |
| 8 | 24 |

FIG.6

64b Planned discharge information

| y | Discharge plan |
|---|---|
| 1 | Present |
| 2 | Not Present |
| 3 | Present |
| 4 | Present |
| 5 | Not Present |
| 6 | Not Present |
| 7 | Not Present |
| 8 | Present |
| 9 | Not Present |
| 10 | Present |
| 11 | Present |
| 12 | Present |
| 13 | Present |
| 14 | Present |
| 15 | Not Present |
| 16 | Present |
| 17 | Present |
| 18 | Not Present |
| 19 | Present |
| 20 | Not Present |
| 21 | Not Present |
| 22 | Not Present |
| 23 | Not Present |
| 24 | Not Present |

FIG.7

64c Ink droplet detection result information

| y | Ink droplet detection result |
|---|---|
| 1 | Detected |
| 2 | Not Detected |
| 3 | Detected |
| 4 | Detected |
| 5 | Not Detected |
| 6 | Not Detected |
| 7 | Not Detected |
| 8 | Detected |
| 9 | Not Detected |
| 10 | Detected |
| 11 | Detected |
| 12 | Detected |
| 13 | Not Detected |
| 14 | Not Detected |
| 15 | Not Detected |
| 16 | Detected |
| 17 | Detected |
| 18 | Not Detected |
| 19 | Detected |
| 20 | Not Detected |
| 21 | Not Detected |
| 22 | Not Detected |
| 23 | Not Detected |
| 24 | Not Detected |

FIG.8

64d Defective nozzle detection result information

| x | Ink droplet no-detection number | Defective nozzle detection result |
|---|---|---|
| 1 | 0 | Normal |
| 2 | 1 | Normal |
| 3 | 0 | Normal |
| 4 | 0 | Normal |
| 5 | 10 | Defective |
| 6 | 0 | Normal |
| 7 | 0 | Normal |
| 8 | 0 | Normal |

FIG.9

INK JET PRINTER

CROSS-REFERENCE TO RELATED APPLICATION

This application claims the priority benefit of Japan application serial no. 2014-000524, filed on Jan. 6, 2014. The entirety of the above-mentioned patent application is hereby incorporated by reference herein and made a part of specification.

BACKGROUND OF THE INVENTION (1) Field of the Invention

The present invention relates to an ink jet printer that detects a defective nozzle among nozzles of an ink jet head.

(2) Description of Related Art

A conventionally known ink jet printer that detects a defective nozzle among nozzles of an ink jet head is provided with the ink jet head in which the nozzles for discharging ink droplets toward a print medium are formed, a light emitting section emitting light for detecting the fling ink droplets that were discharged from the nozzles, and a light receiving section for receiving the light emitted by the light emitting section, in which the ink droplets are detected in a case where an amount of the light received by the light receiving section among the light emitted by the light emitting section is equal to or less than a predetermined amount are known (see JP 3507340 B). This ink jet printer determines a nozzle as being defective in a case where the ink droplet discharged from the nozzle is not detected at a timing of when the ink droplet is scheduled to pass through a dedicated detection region different from a region through which the ink droplet passes at the time of printing onto a print medium.

SUMMARY OF THE INVENTION

However, in the conventional ink jet printer, since ink droplets are discharged only for the purpose of detecting the defective nozzle, there is a problem that the ink necessary for the inherent function of printing is consumed each time the defective nozzle detection is executed.

Thus, the present invention aims to provide an ink jet printer that can suppress wasteful ink consumption.

An ink jet printer of the present invention includes an ink jet head in which a nozzle for discharging an ink droplet toward a print medium is formed; a light emitting section that emits light for detecting the flying ink droplet that was discharged from the nozzle; a light receiving section that receives the light emitted by the light emitting section; a print executor that executes printing by the ink jet head based on print data; an ink droplet detector that detects the ink droplet in a case where an amount of the light received by the light receiving section among the light emitted by the light emitting section is equal to or less than a predetermined amount; and a defective nozzle detector that detects a defective nozzle. The defective nozzle detector determines a nozzle as being defective, in a case where the ink droplet discharged from the nozzle based on the print data in printing executed by the print executor is not detected by the ink droplet detector at a scheduled timing of passing through a detection region to be detected by the ink droplet detector.

According to this configuration, the ink jet printer of the present invention can suppress wasteful ink consumption since it can detect the defective nozzle by the ink droplet that was discharged during printing.

Further, in the ink jet printer of the present invention, the ink jet head may be a serial head that is moved reciprocatingly in a main scanning direction and is moved in a relative manner in a sub scanning direction that perpendicularly intersects with the main scanning direction relative to the print medium, and a width of the detection region in the sub scanning direction may be equal to or greater than a width of a printable range in the sub scanning direction, the printable range being a range that the ink jet head can print by moving only in the main scanning direction, not in the sub scanning direction.

According to this configuration, in the ink jet printer of the present invention, a defect can be detected for all of nozzles in a nozzle row of the ink jet head by moving the ink jet head in the main scanning direction even when the position of the detection region by the ink droplet detector is fixed in the sub scanning direction relative to the ink jet head, whereby a mechanism for moving the light emitting section or the light receiving section in the sub scanning direction relative to the ink jet head does not need to be provided, as a result of which a structural complication can be suppressed.

Further, in the ink jet printer of the present invention, a width of the detection region in the main scanning direction may be equal to or greater than a width of the printable range in the main scanning direction.

According to this configuration, since the ink jet printer of the present invention detects the defective nozzle in an entire region of the printable range in the main scanning direction, an influence of contents of a print target image on the execution of the defective nozzle detection can be decreased, as a result of which defective nozzle detection accuracy can be improved.

Further, in the ink jet printer of the present invention, the print executor may execute a multipath printing that prints a plurality of portions having a same position in the sub scanning direction and respectively different positions in the main scanning direction by a plurality of the nozzles having respectively different positions in the sub scanning direction in the ink jet head.

According to this configuration, compared to a configuration that prints the plurality of portions having the same position in the sub scanning direction and respectively different positions in the main scanning direction by using the same nozzle in the ink jet head, the ink jet printer of the present invention detects a defect of the same nozzle at larger number of positions within the print target image along the sub scanning direction. Therefore, the influence of the contents of the print target image on the execution of the defective nozzle detection can be reduced, as a result of which the defective nozzle detection accuracy can be improved.

The ink jet printer of the present invention can suppress wasteful ink consumption.

BRIEF DESCRIPTION OF THE DRAWINGS

FIG. 6 is a diagram showing an example of detection target position information shown in FIG. 4;

FIG. 7 is a diagram showing an example of planned discharge information shown in FIG. 4;

FIG. 8 is a diagram showing an example of ink droplet detection result information shown in FIG. 4;

FIG. 9 is a diagram showing an example of defective nozzle detection result information shown in FIG. 4;

DETAILED DESCRIPTION OF PREFERRED EMBODIMENTS

Hereinbelow, embodiments of the present invention will be described with reference to the drawings.

(First Embodiment)

Firstly, a configuration of an ink jet printer of a first embodiment of the present invention will be described.

Figure 1:
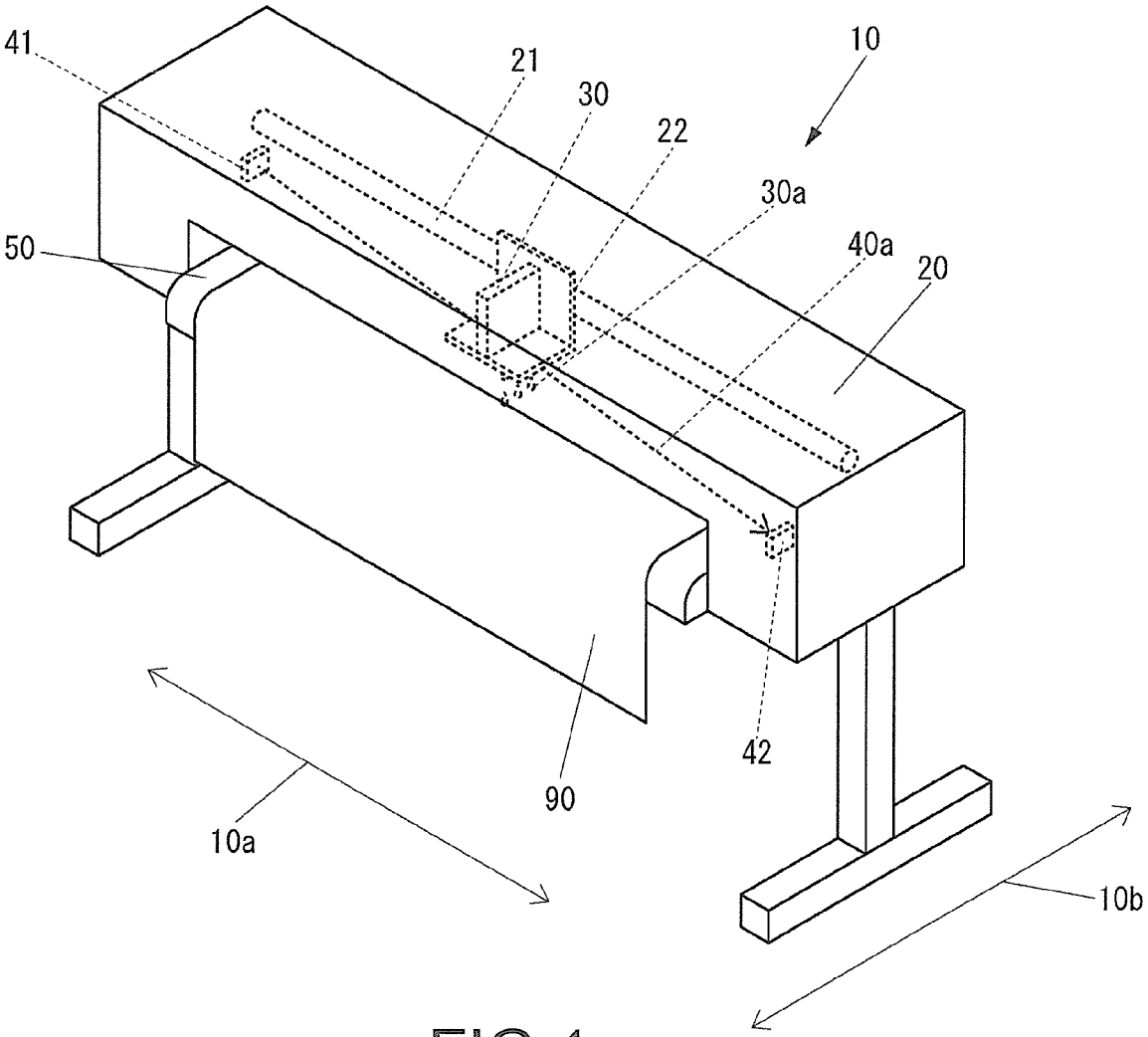
FIG. 1 is a perspective view of an ink jet printer of a first embodiment of the present invention.

FIG. 1 is a perspective view of an ink jet printer 10 of the present embodiment.

As shown in FIG. 1, the ink jet printer 10 includes a main body 20 extending in a main scanning direction shown by an arrow 10*a*, and a transfer device 50 that transfers a print medium 90 such as paper in a sub scanning direction shown by an arrow 10*b* that perpendicularly intersects with the main scanning direction.

The main body 20 includes a guide rail 21 extending in the main scanning direction shown by the arrow 10*a*, a carriage 22 movably supported by the guide rail 21 in the main scanning direction, an ink jet head 30 that is mounted on the carriage 22 and discharges ink droplets 30*a* toward the print medium 90, a light emitting section 41 that emits light 40*a* for detecting the flying ink droplets 30*a* that was discharged from the ink jet head 30, and a light receiving section 42 that receives the light 40*a* emitted by the light emitting section 41.

The ink jet head 30 is a serial head that is moved reciprocatingly in the main scanning direction shown by the arrow 10*a*, and is moved in a relative manner in the sub scanning direction shown by the arrow 10*b* relative to the print medium 90 by the print medium 90 being transferred by the transfer device 50.

The light emitting section 41 is, for example, configured of an LED (Light Emitting Diode) or an LD (Laser Diode).

The light receiving section 42 is, for example, configured of a PD (Photodiode).

Figure 2:
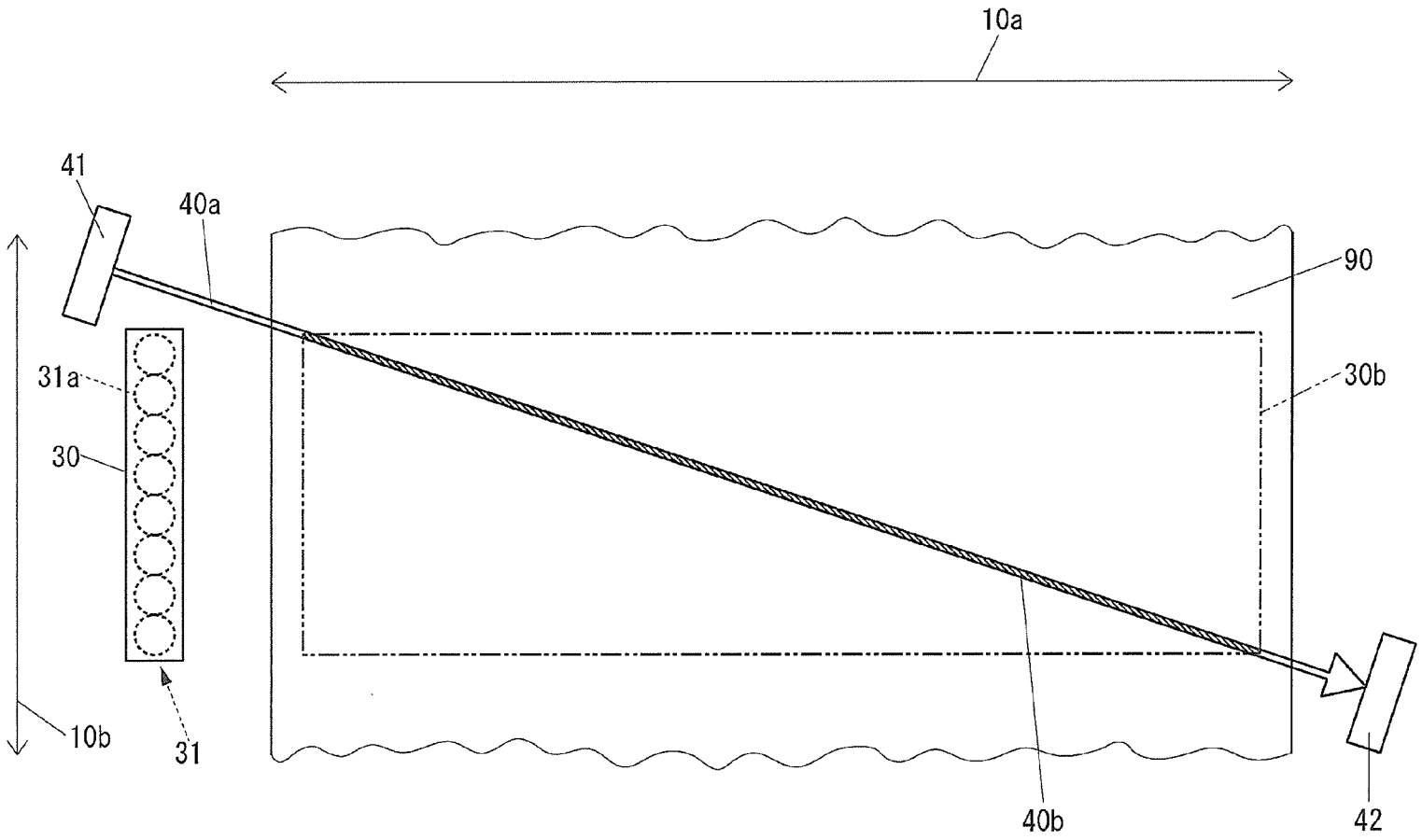
FIG. 2 is a plan view of an ink jet head, a light emitting section, and a light receiving section in the ink jet printer shown in FIG. 1.
Figure 3:
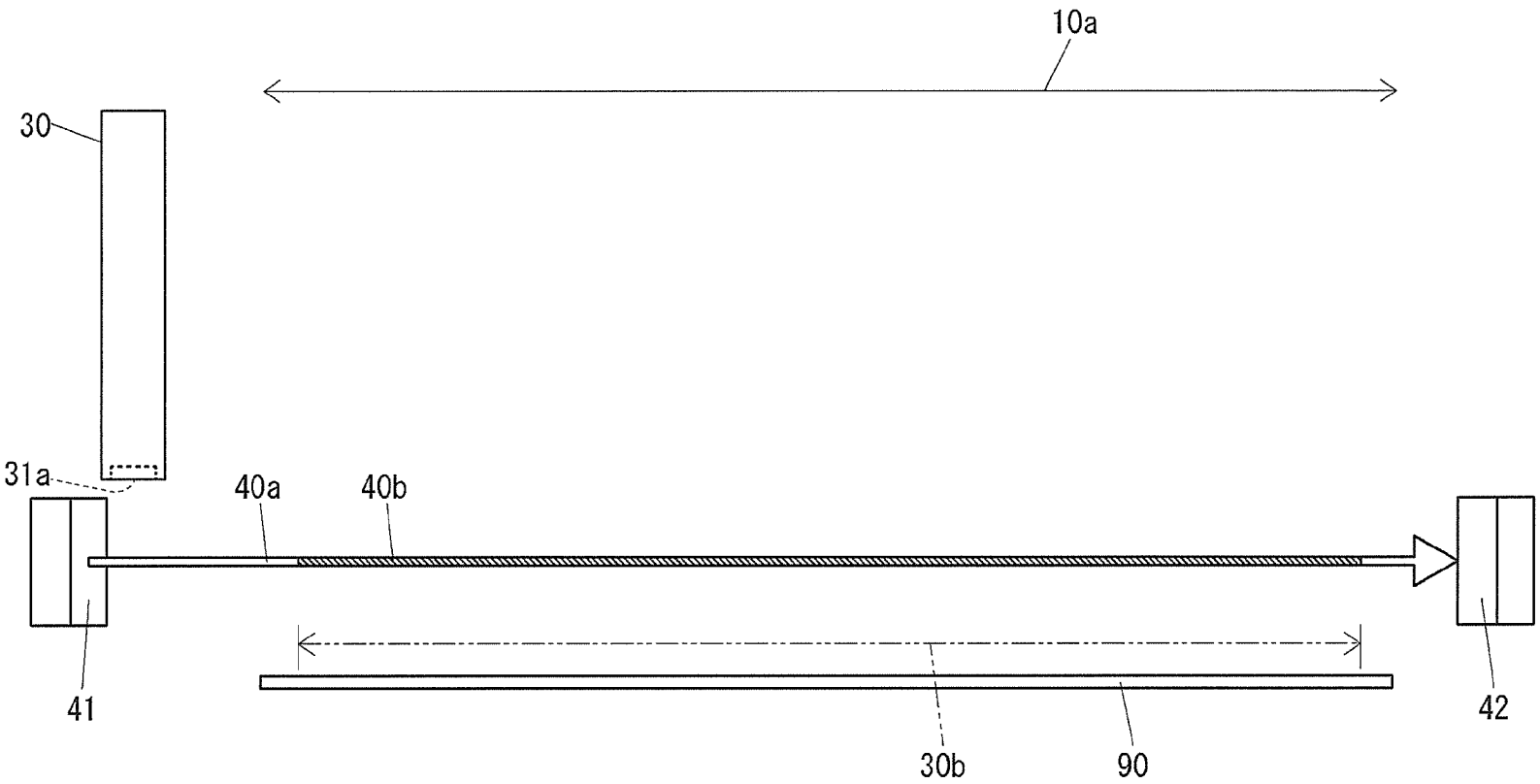
FIG. 3 is a front view of the ink jet head, the light emitting section, and the light receiving section shown in FIG. 2.

FIG. 2 is a plan view of the ink jet head 30, the light emitting section 41 and the light receiving section 42 in the ink jet printer 10. FIG. 3 is a front view of the ink jet head 30, the light emitting section 41 and the light receiving section 42.

As shown in FIG. 2 and FIG. 3, the ink jet head 30 has a row 31 of nozzles 31*a* for discharging the ink droplets 30*a* (see FIG. 1) toward the print medium 90 formed therein (hereinbelow referred to as "nozzle row"). The nozzle row 31 extends in the sub scanning direction shown by the arrow 10*b*.

In FIG. 2 and FIG. 3, a printable range 30*b* which the ink jet head 30 can print when the ink jet head 30 is present at a position shown in FIG. 2 and FIG. 3 relative to the print medium 90 in the sub scanning direction shown by the arrow 10*b* is shown by a two-dot chain line. The printable range 30*b* is a range that the ink jet head 30 can print by moving only in the main scanning direction shown by the arrow 10*a*, not in the sub scanning direction.

Figure 4:
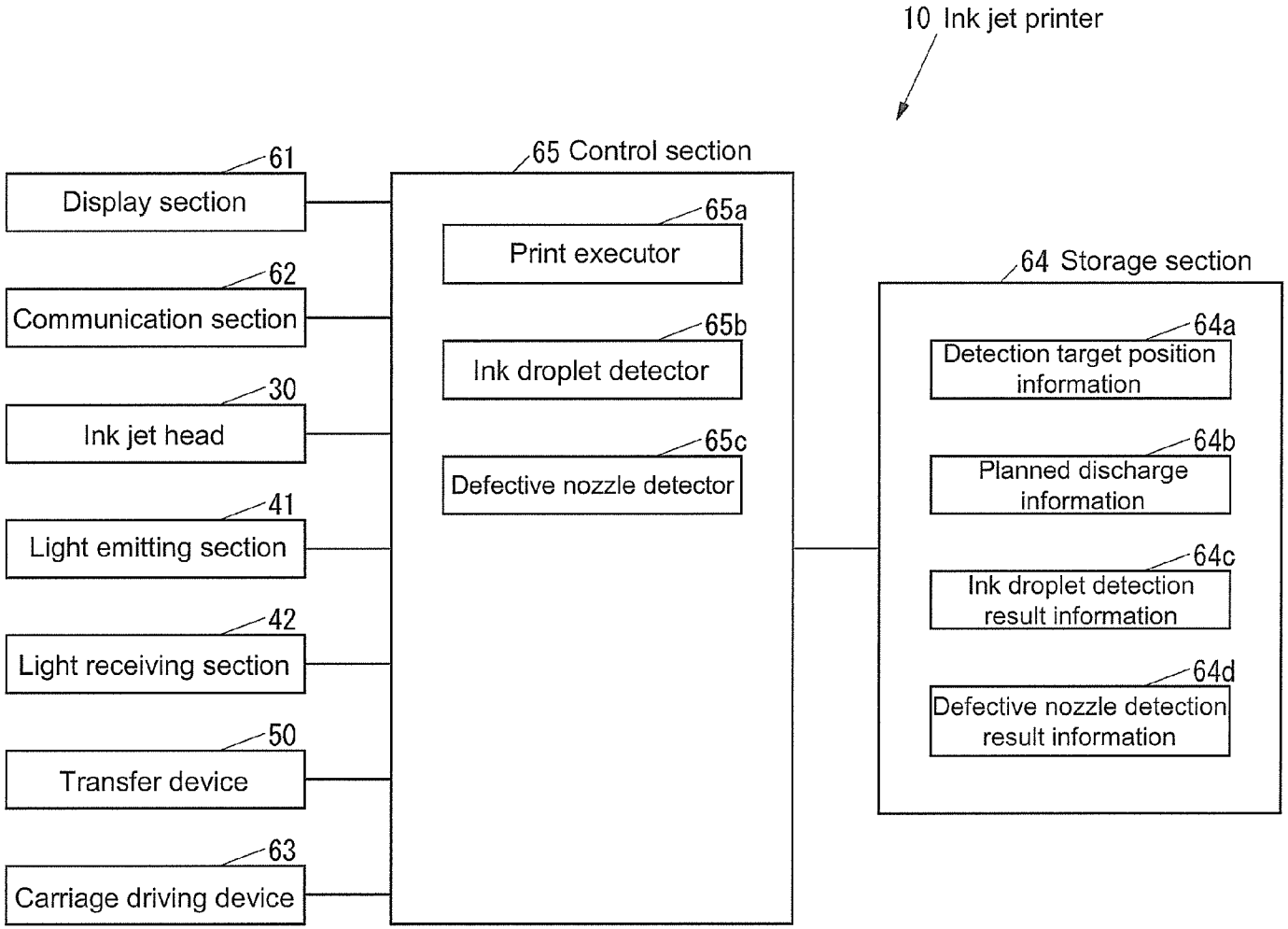
FIG. 4 is a block diagram of the ink jet printer shown in FIG. 1.

FIG. 4 is a block diagram of the ink jet printer 10.

As shown in FIG. 4, the ink jet printer 10 includes a display section 61 that is a display device such as an LCD (Liquid Crystal Display) for displaying various types of information, a communication section 62 that is a communication device for performing communication with an external device such as a PC (Personal Computer), the aforementioned ink jet head 30, light emitting section 41, light receiving section 42, and transfer device 50, a carriage driving device 63 for moving the carriage 22 (see FIG. 1) in the main scanning direction shown by the arrow 10*a* (see FIG. 1), a storage section 64 that is a storage device such has an EEPROM (Electrically Erasable Programmable Read Only Memory) for storing various types of data, and a control section 65 that controls an entirety of the ink jet printer 10.

The control section 65, for example, includes a CPU (Central Processing Unit), a ROM (Read Only Memory) that predeterminedly stores program and various types of data, and a RAM (Random Access Memory) used as work area for the CPU. The CPU is configured to execute the program stored in the ROM or the storage section 64.

The control section 65 functions, by executing the program stored in the ROM, as a print executor 65*a* that executes printing by the ink jet head 30 based on print data, an ink droplet detector 65*b* that detects the ink droplets 30*a* (see FIG. 1) in a case where an amount of light received by the light receiving section 42 among the light 40*a* (see FIG. 1) emitted by the light emitting section 41 is equal to or less than a predetermined amount, and a defective nozzle detector 65*c* that detects a defective nozzle 31*a* (see FIG. 2).

In FIG. 2 and FIG. 3, a detection region 40*b* by the ink droplet detector 65*b* is shown by hatching. A width of the detection region 40*b* in the main scanning direction shown by the arrow 10*a* is equal to or greater than a width of the printable range 30*b* in the main scanning direction. Further, a width of the detection region 40*b* in the sub scanning direction shown by the arrow 10*b* is equal to or greater than a width of the printable range 30*b* in the sub scanning direction.

Figure 5:
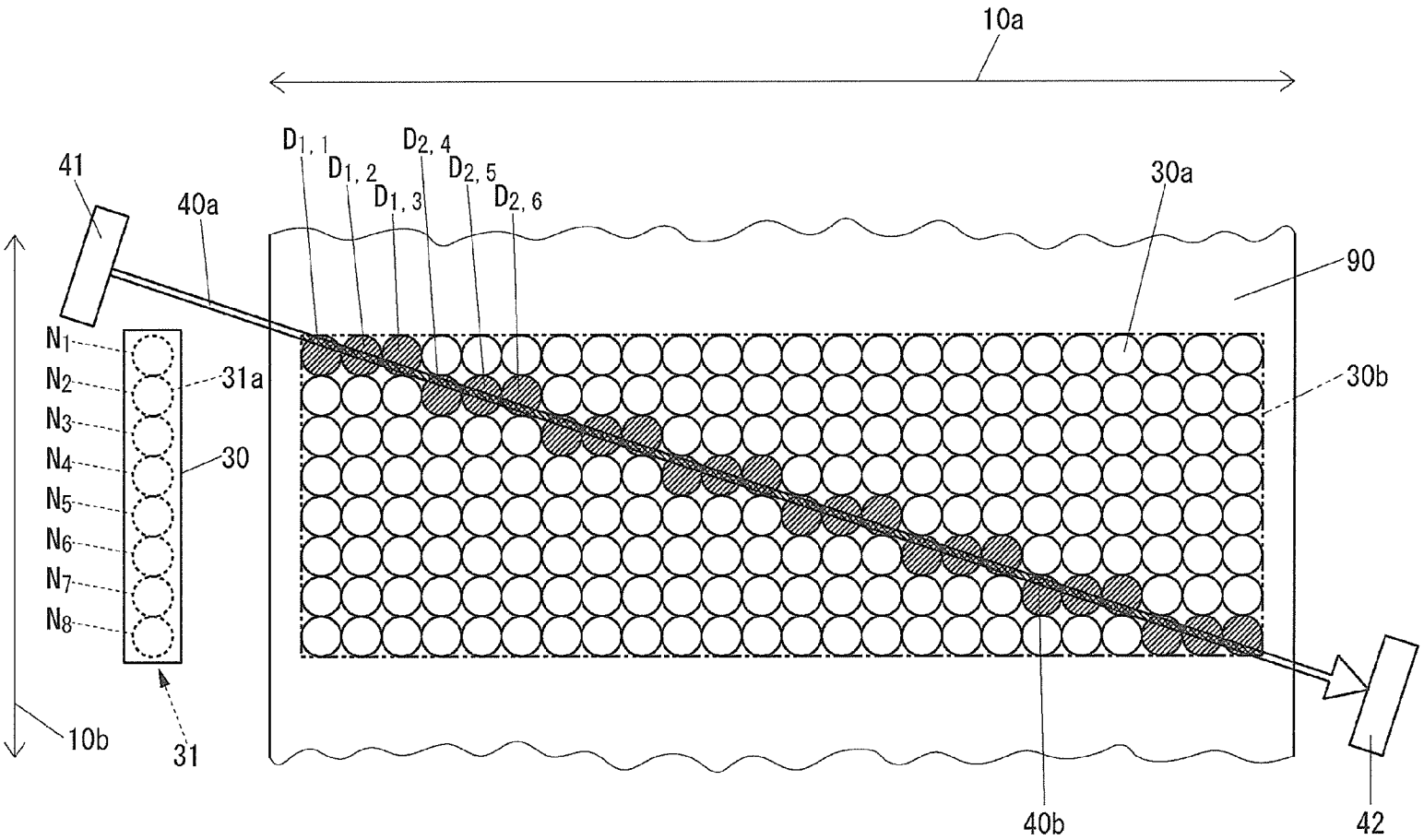
FIG. 5 is a diagram showing a relationship between a detection region shown in FIG. 2 and ink droplets.

FIG. 5 is a diagram showing a relationship between the detection region 40*b* shown in FIG. 2 and the ink droplets 30*a*.

FIG. 5 shows the ink droplets 30*a* that may possibly be discharged by the ink jet head 30 when the ink jet head 30 is present at a position shown in FIG. 5 in the sub scanning direction shown by the arrow 10*b* relative to the print medium 90. As shown in FIG. 5, twenty-four ink droplets 30*a* in the main scanning direction shown by the arrow 10*a* and eight ink droplets 30*a* in the sub scanning direction may be discharged in the printable range 30*b*. The ink droplets 30*a* shown by hatching in FIG. 5 are ink droplets that are to be the target of detection by the ink droplet detector 65*b*.

The ink droplets 30*a* shown in FIG. 5 can be denoted as $D_{x,y}$. Here, x is a number to which "1" to "8" are given in this order to the ink droplets 30*a* from one end to the other end in the sub scanning direction shown by the arrow 10*b* in the printable range 30*b*. y is a number to which "1" to "24" are given in this order to the ink droplets 30*a* from one end to the other end in the main scanning direction shown by the arrow 10*a* in the printable range 30*b*. It should be noted that y corresponds to a position of the ink jet head 30 in the main scanning direction at the time of discharging the ink droplet $D_{x,y}$.

The nozzles 31*a* shown in FIG. 5 can be denoted as $N_x$. Here, x is a number to which "1" to "8" are given in this order to the nozzles 31*a* from one end to the other end in the sub scanning direction shown by the arrow 10*b* in the nozzle row 31. It should be noted that x in $D_{x,y}$ corresponds to the position of the nozzle $N_x$ of the ink jet head 30 at the time of discharging the ink droplet $D_{x,y}$.

As shown in FIG. 4, the storage section 64 can store detection target position information 64*a* that indicates a position of the ink droplet 30*a* to be the detection target by the ink droplet detector 65*b*.

FIG. 6 is a diagram showing an example of the detection target position information 64*a*.

As shown in FIG. 6, the detection target position information 64*a* is configured by a combination of x indicating a position in the sub scanning direction shown by the arrow 10*b* (see FIG. 5) and y indicating a position in the main scanning direction shown by the arrow 10*a* (see FIG. 5). The ink droplets 30*a* shown by the hatching in FIG. 5 are expressed by the detection target position information 64*a* shown in FIG. 6.

As shown in FIG. 4, the storage section 64 can store planned discharge information 64*b* indicating a plan for discharge by the ink jet head 30, for the ink droplets 30*a* to be the detection target by the ink droplet detector 65*b*.

FIG. 7 is a diagram showing an example of the planned discharge information 64*b*.

As shown in FIG. 7, the planned discharge information 64*b* is configured of a combination of y indicating a position in the main scanning direction shown by the arrow 10*a* (see FIG. 5) and the discharge plan of the ink droplets 30*a* (see FIG. 5) to be the detection target by the ink droplet detector 65*b* (see FIG. 4) when the ink jet head 30 (see FIG. 5) is present at the position y.

As shown in FIG. 4, the storage section 64 can store ink droplet detection result information 64*c* indicating a detection result by the ink droplet detector 65*b* (hereinbelow referred to as "ink droplet detection result").

FIG. 8 is a diagram showing an example of the ink droplet detection result information 64*c*.

As shown in FIG. 8, the ink droplet detection result information 64*c* is configured by a combination of y indicating a position in the main scanning direction shown by the arrow 10*a* (see FIG. 5) and the ink droplet detection result in the case where the ink jet head 30 (see FIG. 5) is present at the position y.

As shown in FIG. 4, the storage section 64 can store defective nozzle detection result information 64*d* indicating a detection result by the defective nozzle detector 65*c* (hereinbelow referred to as "defective nozzle detection result").

FIG. 9 is a diagram showing an example of the defective nozzle detection result information 64*d*.

As shown in FIG. 9, the defective nozzle detection result information 64*d* is configured of a combination of x indicating a position in the sub scanning direction shown by the arrow 10*b* (see FIG. 5), the number of times that the ink droplets 30*a* (see FIG. 5) discharged from the nozzle $N_x$ were not detected by the ink droplet detector 65*b* (see FIG. 4) (hereinbelow referred to as "ink droplet no-detection number"), and the defective nozzle detection result for the nozzle $N_x$.

It should be noted that the defective nozzle detection result information 64*d* in its initial state has all of the ink droplet no-detection numbers set to 0, and all of the defective nozzle detection results to "normal".

Next, an operation of the ink jet printer 10 will be described.

The print executor 65*a* of the control section 65 of the ink jet printer 10 executes printing by the ink jet head 30 based on print data when the incoming print data is received via the communication section 62.

Specifically, the print executor 65*a* controls the carriage driving device 63 to move the carriage 22 along the guide rail 21 in the main scanning direction shown by the arrow 10*a*, so that the ink jet head 30 mounted on the carriage 22 is moved in the main scanning direction relative to the print medium 90. At this occasion, the print executor 65*a* executes printing in the main scanning direction by causing the ink droplets 30*a* to be discharged by the ink jet head 30 toward the print medium 90. Further, the print executor 65*a* controls the transfer device 50 each time printing in the main scanning direction is finished to move the print medium 90 in the sub scanning direction shown by the arrow 10*b*, so that the ink jet head 30 is moved in a relative manner in the sub scanning direction relative to the print medium 90 to execute printing in the main scanning direction again at a subsequent position in the sub scanning direction.

For each printing in the main scanning direction shown by the arrow 10*a* which is performed by the ink jet head 30 (hereinbelow referred to as "main scan printing") among the printing executed by the print executor 65*a*, the defective nozzle detector 65*c* of the control section 65 performs an operation shown in FIG. 10 just before the main scan printing. It should be noted that the defective nozzle detector 65*c* does not execute the operation shown in FIG. 10 while the main scan printing is being performed by the print executor 65*a* and until the main scan printing is finished. Further, the print executor 65*a* does not execute subsequent main scan printing until the operation shown in FIG. 10 is finished.

Figure 10:
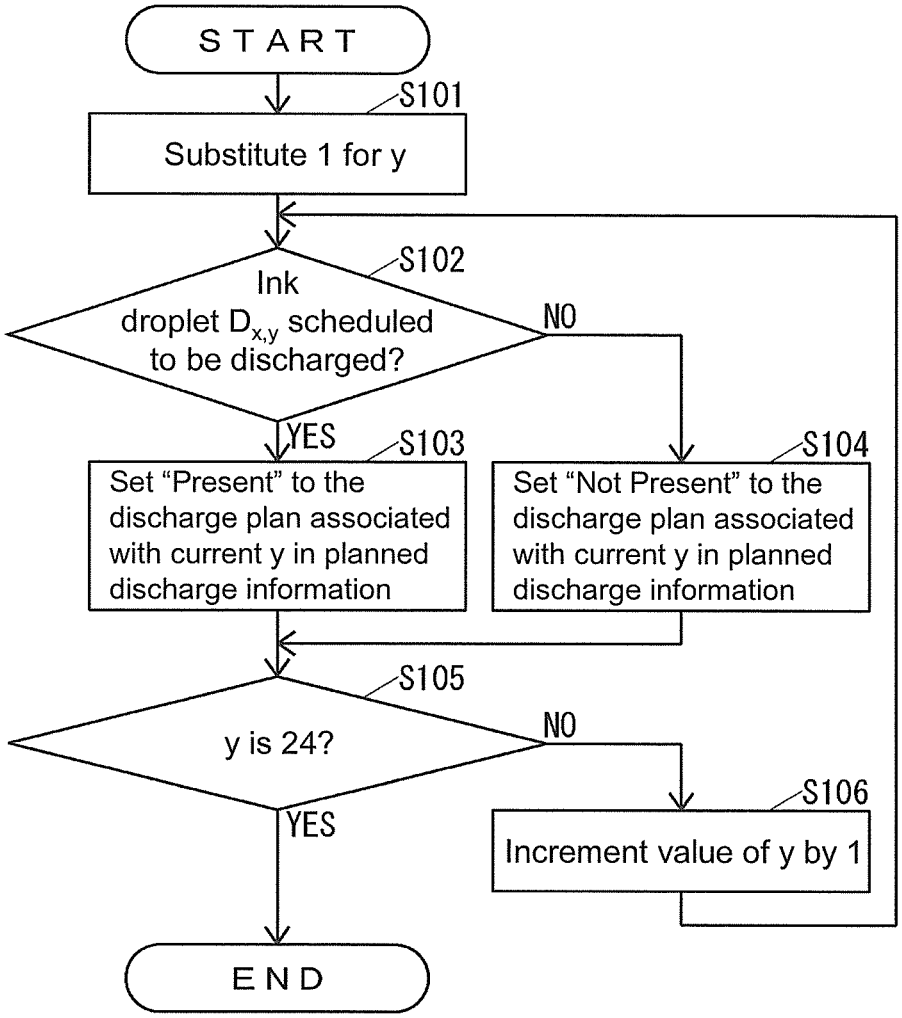
FIG. 10 is a flowchart of an operation of the ink jet printer shown in FIG. 1 in a case of updating the planned discharge information.

FIG. 10 is a flowchart of an operation of the ink jet printer 10 in a case of updating the planned discharge information 64*b*.

As shown in FIG. 10, the defective nozzle detector 65*c* substitutes "1" for y (S101).

Then, the defective nozzle detector 65*c* determines whether or not an ink droplet $D_{x,y}$, corresponding to the current y and the x associated with this y in the detection target position information 64*a* in the storage section 64 is scheduled to be discharged in a main scan printing to be executed by the print executor 65*a* next (hereinbelow referred to as "target main scan printing") among the main scan printing scheduled for the print data that is to be the basis of the printing by the print executor 65*a* (hereinbelow referred to as "target print data"), based on the target print data (S102).

In determining that the discharge is scheduled in S102, the defective nozzle detector 65*c* changes the discharge plan associated with the current y in the planned discharge information 64*b* in the storage section 64 to "Present" (S103).

In determining that the discharge is not scheduled in S102, the defective nozzle detector 65*c* changes the discharge plan associated with the current y in the planned discharge information 64*b* in the storage section 64 to "Not Present" (S104).

When the process of S103 or S104 is ended, the defective nozzle detector 65*c* determines whether the y is "24" or not (S105).

In determining that the y is not "24" in S105, the defective nozzle detector 65*c* increments the value of y by one (S106), and executes the process of S102.

In determining that the y is "24" in S105, the defective nozzle detector 65*c* ends the operation shown in FIG. 10.

For example, in determining, based on the target print data, that an ink droplet D1,1 corresponding to "1,1" being one of x,y in the detection target position information 64*a* shown in FIG. 6 is scheduled to be discharged in the target main scan printing (YES in S102), the defective nozzle detector 65*c* sets the discharge plan corresponding to the current y, which is "1", in the planned discharge information 64*b* to "Present" as shown in FIG. 7 (S103). Further, in determining, based on the target print data, that an ink droplet $D_{1,2}$ corresponding to "1,2" being one of x,y in the detection target position information 64*a* shown in FIG. 6 is not scheduled to be discharged in the target main scan printing (NO in S102), the defective nozzle detector 65*c* sets the discharge plan corresponding to the current y, which is "2", in the planned discharge information 64*b* to "Not Present" as shown in FIG. 7 (S104).

Figure 11:
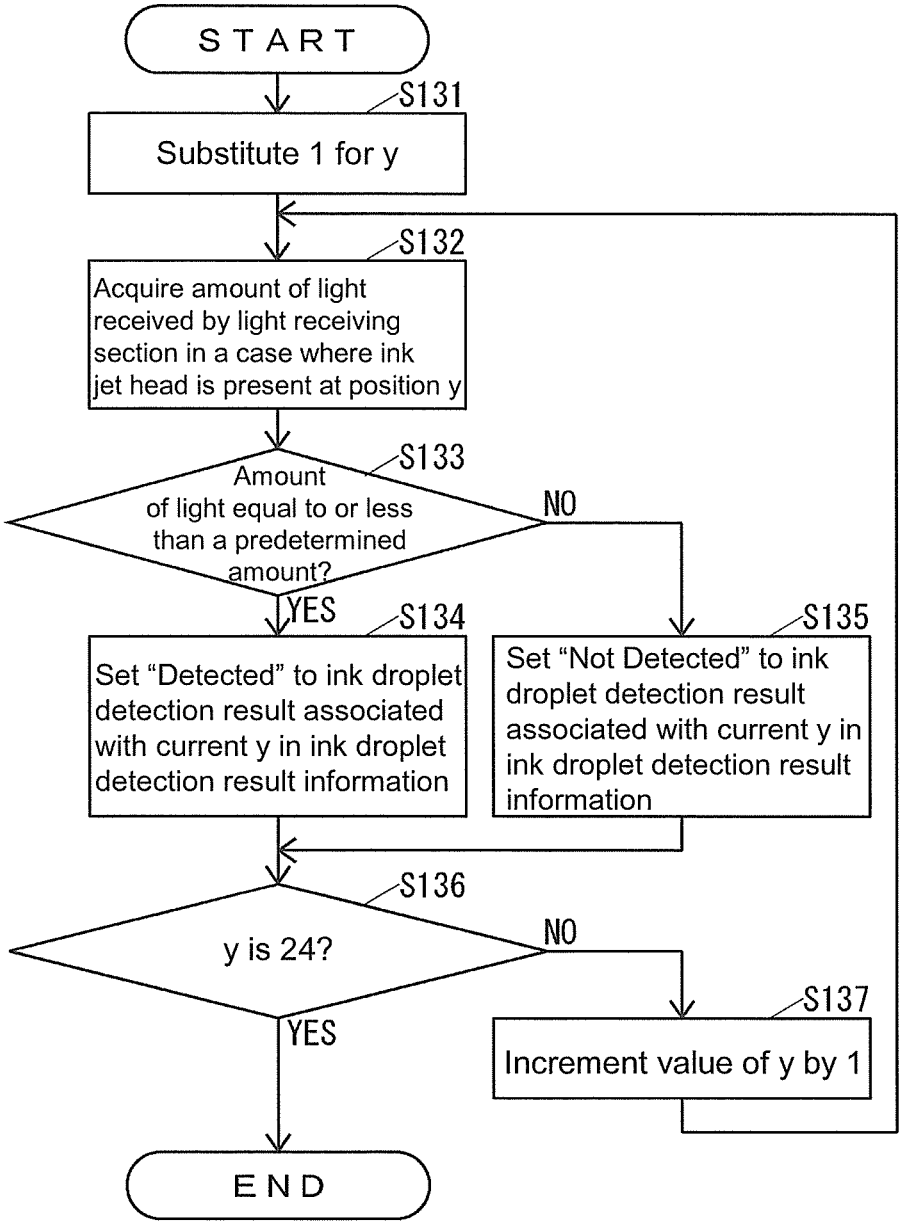
FIG. 11 is a flowchart of an operation of the ink jet printer shown in FIG. 1 in a case of updating the ink droplet detection result information.

The ink droplet detector 65*b* of the control section 65 executes an operation shown in FIG. 11 during the main scan printing, for each of the main scan printing executed by the print executor 65*a*.

FIG. 11 is a flowchart of an operation of the ink jet printer 10 in a case of updating the ink droplet detection result information 64*c*.

As shown in FIG. 11, the ink droplet detector 65*b* substitutes "1" for y (S131).

Then, the ink droplet detector 65*b* acquires the amount of light received by the light receiving section 42 among the light 40*a* emitted by the light emitting section 41 at the timing of when the ink droplets 30*a* discharged from the nozzles 31*a* are scheduled to pass through the detection region 40*b* in a case where the ink jet head 30 is present at the position y (S132).

Then, the ink droplet detector 65*b* determines whether or not the amount of light acquired in S132 is equal to or less than a predetermined amount (S133).

In determining that the amount is equal to or less than the predetermined amount in S133, the ink droplet detector 65*b* sets the ink droplet detection result corresponding to the current y in the ink droplet detection result information 64*c* in the storage section 64 to "Detected" (S134).

In determining that the amount is not equal to or less than the predetermined amount in S133, the ink droplet detector 65*b* sets the ink droplet detection result corresponding to the current y in the ink droplet detection result information 64*c* in the storage section 64 to "Not Detected" (S135).

When the process of S134 or S135 is ended, the ink droplet detector 65*b* determines whether the y is "24" or not (S136).

In determining that the y is not "24" in S136, the ink droplet detector 65*b* increments the value of y by one (S137), and executes the process of S132.

In determining that the y is "24" in S136, the ink droplet detector 65*b* ends the operation shown in FIG. 11.

Figure 12A:
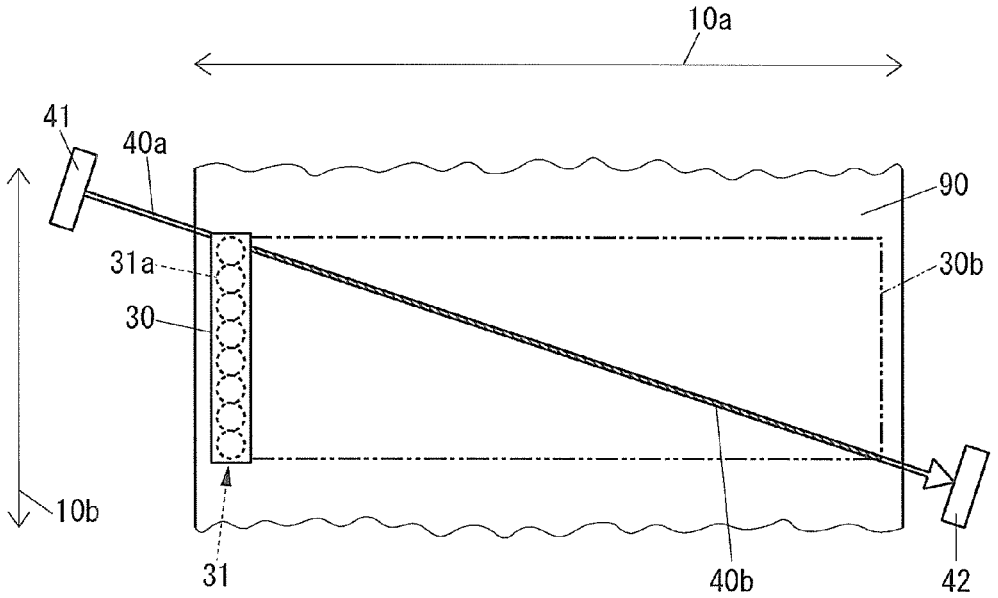
FIG. 12A is a plan view of the ink jet head, the light emitting section, and the light receiving section shown in FIG. 2 in a case where the ink droplets are discharged on a print medium by the ink jet head.
Figure 12B:
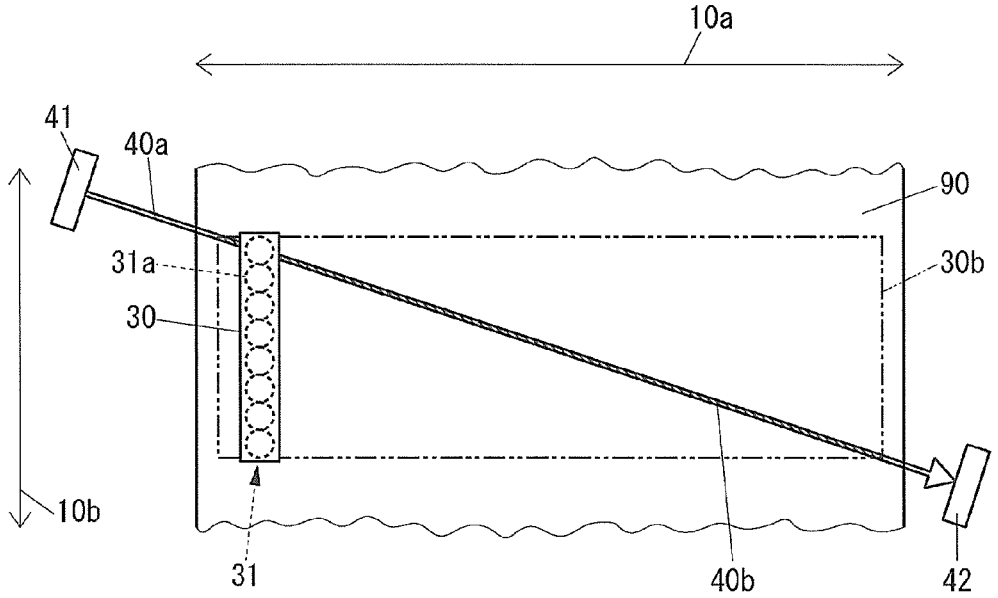
FIG. 12B is a plan view of the ink jet head, the light emitting section, and the light receiving section shown in FIG. 2 in a state where the ink droplets are discharged on the print medium by the ink jet head when a position of the ink jet head is different from a position shown in FIG. 12A.

For example, in determining that the amount of light received by the light receiving section 42 among the light 40*a* emitted by the light emitting section 41 is equal to or less than the predetermined amount (YES to S133) at the timing of when the ink droplets 30*a* discharged from the nozzles 31*a* are scheduled to pass through the detection region 40*b* in the case where the ink jet head 30 is present at the position where the y is "1", as shown in FIG. 12A, the ink droplet detector 65*b* sets the ink droplet detection result corresponding to "1", being the current y, in the ink droplet detection result information 64*c* to "Detected" as shown in FIG. 8 (S134). Further, in determining that the amount of light received by the light receiving section 42 among the light 40*a* emitted by the light emitting section 41 is more than the predetermined amount (NO to S133) at the timing of when the ink droplets 30*a* discharged from the nozzles 31*a* are scheduled to pass through the detection region 40*b* in the case where the ink jet head 30 is present at the position where the y is "2", as shown in FIG. 12B, the ink droplet detector 65*b* sets the ink droplet detection result corresponding to "2", being the current y, in the ink droplet detection result information 64*c* to "Not Detected" as shown in FIG. 8 (S135).

Figure 13:
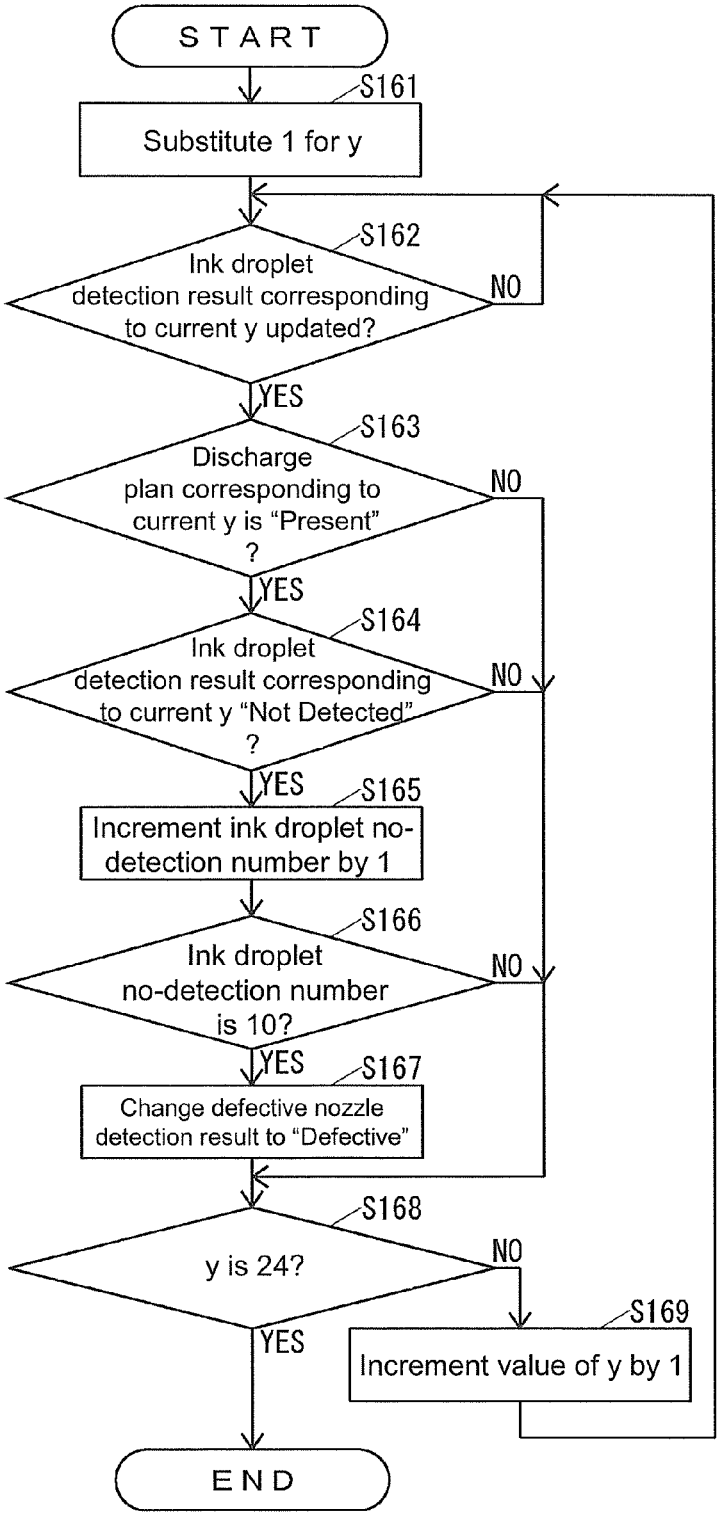
FIG. 13 is a flowchart of an operation of the ink jet printer shown in FIG. 1 in a case of updating the defective nozzle detection result information.

The defective nozzle detector 65*c* executes an operation shown in FIG. 13 during the main scan printing, for each of the main scan printing performed by the print executor 65*a*.

FIG. 13 is a flowchart of an operation of the ink jet printer 10 in a case of updating the defective nozzle detection result information 64*d*.

As shown in FIG. 13, the defective nozzle detector 65*c* substitutes "1" for the y (S161).

Next, the defective nozzle detector 65*c* determines whether or not the ink droplet detection result corresponding to the current y was updated in the operation shown in FIG. 11 in the ink droplet detection result information 64*c* in the storage section 64, until it is determined that the ink droplet detection result corresponding to the current y in the ink droplet detection result information 64*c* in the storage section 64 is updated by the operation shown in FIG. 11, that is, until it is determined that the process of S134 or S135 was performed for the ink droplet detection result corresponding to the current y (S162).

In determining that the ink droplet detection result corresponding to the current y in the ink droplet detection result information 64*c* in the storage section 64 was updated by the operation shown in FIG. 11 in S162, the defective nozzle detector 65*c* determines whether or not the discharge plan associated with the current y in the planned discharge information 64*b* in the storage section 64 is "Present" (S163).

In determining "Present" in S163, the defective nozzle detector 65*c* determines whether or not the ink droplet detection result corresponding to the current y in the ink droplet detection result information 64*c* in the storage section 64 is "Not Detected" (S164).

In determining "Not Detected" in S164, the defective nozzle detector 65*c* increments the ink droplet no-detection number associated with the x, which is associated with the current y in the detection target position information 64*a* in the storage section 64, in the defective nozzle detection result information 64*d* in the storage section 64 by one (S165).

Next, the defective nozzle detector 65*c* determines whether or not the ink droplet no-detection number that was incremented by one in S165 is "10" (S166).

In determining "10" S166, the defective nozzle detector 65*c* changes the defective nozzle detection result corresponding to the x, which is associated with the current y in the detection target position information 64*a* in the storage section 64, in the defective nozzle detection result information 64*d* in the storage section 64 to "Defective" (S167).

The defective nozzle detector 65*c* determines whether or not the y is "24" when "Not Present" is determined in S163, "Detected" is determined in S164, or not being "10" is determined in S166, or when the process of S167 is finished (S168).

In determining that the y is not "24" in S168, the defective nozzle detector 65*c* increments the value of y by one (S169), and executes the process of S162.

In determining that the y is "24" in S168, the defective nozzle detector 65*c* ends the operation shown in FIG. 13.

For example, in a case where the y is "13", the defective nozzle detector 65*c* increments the ink droplet no-detection number by one, the ink droplet no-detection number being associated with the x being "5" in the defective nozzle detection result information 64*d*, the x being associated with "13" as the y in the detection target position information 64*a* shown in FIG. 6 (S165), since the discharge plan in the planned discharge information 64*b* shown in FIG. 7 is "Present" (YES in S163), and the ink droplet detection result in the ink droplet detection result information 64*c* shown in FIG. 8 is "Not Detected" (YES in S164). Further, when the ink droplet no-detection number associated with "5" as the x reaches "10", as in the defective nozzle detection result information 64*d* shown in FIG. 9 (YES in S166), the defective nozzle detector 65*c* changes the defective nozzle detection result corresponding to "5" as the x to "Defective" as in the defective nozzle detection result information 64*d* shown in FIG. 9 (S167).

It should be noted that when information of "Defective" is generated in the defective nozzle detection result in the defective nozzle detection result information 64*d*, the control section 65 performs an operation that is predeterminedly set as an operation for a case where defect has occurred in the nozzles 31*a*. For example, for a nozzle 31*a* of which defective nozzle detection result in the defective nozzle detection result information 64*d* is "Defective", the control section 65 may display information indicating that it is defective on the display section 61. Further, the control section 65 may perform a nozzle recovery operation to discharge ink droplets 30*a* by a normal nozzle 31*a* instead of the defective nozzle 31*a*.

As described above, the ink jet printer 10 updates the planned discharge information 64*b* based on the print data and the detection target position information 64*a* (S101 to S106), and in the case where the ink jet head 30 is at the position where the discharge plan is "Present" in the planned discharge information 64*b* (YES in S163), when the ink droplets 30*a* discharged from the nozzle 31*a* are not detected at the scheduled timing of passing through the detection region 40*b* (YES in S164), it is determined that the nozzle 31*a* thereof, that is, the nozzle 31*a* associated, in the detection target position information 64*a*, with the position where the ink jet head 30 is present as a defective nozzle (S167). That is, the ink jet printer 10 determines the defective nozzle 31*a* based on the print data. Accordingly, the ink jet printer 10 can detect the defective nozzle 31*a* by the ink droplets 30*a* that were discharged during printing, whereby the wasteful ink consumption can be suppressed compared to the conventional cases.

Figure 14:
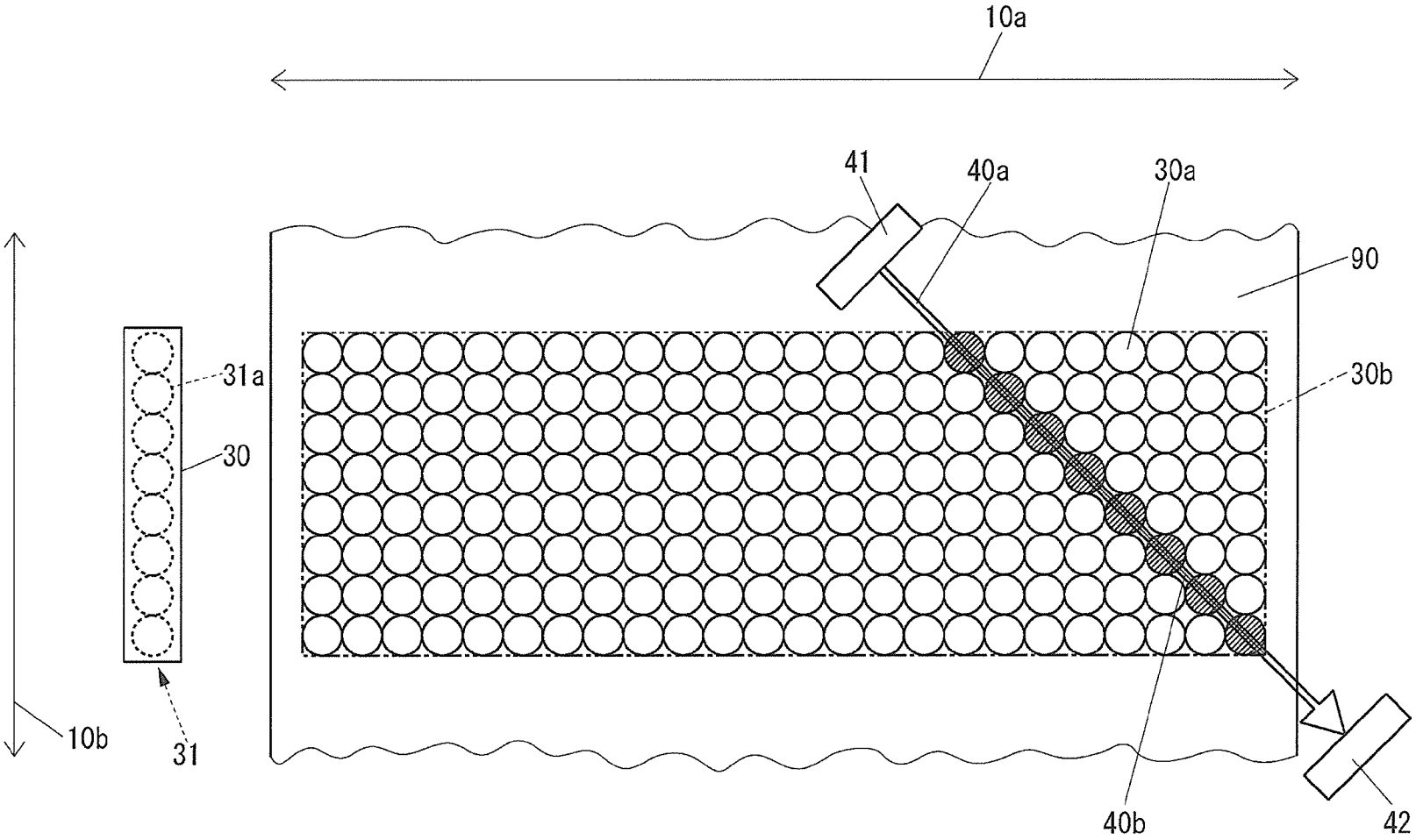
FIG. 14 is a diagram showing a relationship between a detection region and ink droplets in an example different from the example shown in FIG. 5 of the ink jet printer shown in FIG. 1.
Figure 15:
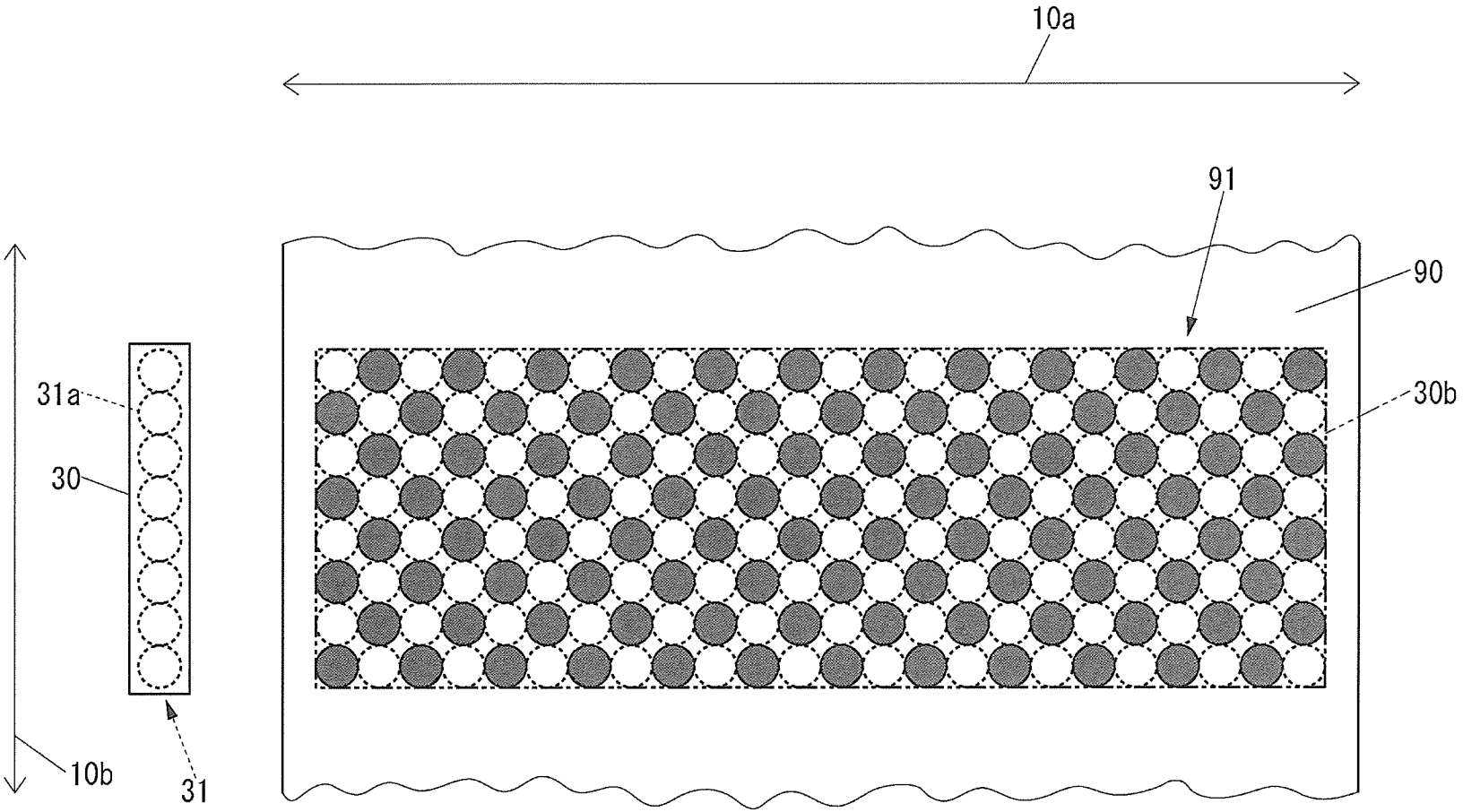
FIG. 15 is a diagram showing an example of a print target image of the ink jet printer shown in FIG. 1.

As shown in FIG. 5, in the ink jet printer 10, the width of the detection region 40*b* in the main scanning direction shown by the arrow 10*a* is equal to or greater than the width of the printable range 30*b* as shown in FIG. 14, for example, but the width of the detection region 40*b* in the main scanning direction may be less than the width of the printable range 30*b*. However, in the case of having the configuration shown in FIG. 5, the ink jet printer 10 has a wider detection range of the ink droplets 30*a* for each of the nozzles 31*a* in the main scanning direction compared to the configuration shown in FIG. 14 in the event of moving the ink jet head 30 in the main scanning direction. That is, in the case of having the configuration shown in FIG. 14, the ink jet printer 10 has the detection range of the ink droplets 30*a* for each of the nozzles 31*a* corresponding to one ink droplet 30*a*, whereas in the case of having the configuration shown in FIG. 5, the detection range of the ink droplets 30*a* for each of the nozzles 31*a* corresponds to three ink droplets 30*a*. Here, the description will be given based on a case where the print target image is an image 91 shown, for example, in FIG. 15. In FIG. 15, circles within the image 91 having the inner side colored in gray indicate portions where the ink droplets 30*a* are planned to be discharged, and white circles depicted by dotted outline in the image 91 indicate portions where the ink droplets 30*a* are not planned to be discharged. If the print target image is the image 91 shown, for example, in FIG. 15, the ink jet printer 10 with the configuration shown in FIG. 14 cannot detect the defective nozzle 31*a* since there originally is no plan to discharge the ink droplets 30*a* in the detection region 40*b*, but the ink jet printer 10 with the configuration shown in FIG. 5 may be able to detect the defective nozzle 31*a* since there is a plan to discharge the ink droplets 30*a* in a part of the detection region 40*b*. That is, in the ink jet printer 10, unlike the configuration shown in FIG. 14, the configuration shown in FIG. 5 detects the defective nozzle 31*a* in an entire region of the printable range 30*b* in the main scanning direction. Therefore, the influence of contents of the print target image on the execution of the detection of the defective nozzle 31*a* can be reduced. Accordingly, with the configuration shown in FIG. 5, the ink jet printer 10 can improve the detection accuracy of the defective nozzle 31*a* compared to the configuration shown in FIG. 14.

As shown in FIG. 5, in the ink jet printer 10, since the width of the detection region 40*b* in the sub scanning direction shown by the arrow 10*b* is equal to or greater than the width of the printable range 30*b*, the defect can be detected in all of the nozzles 31*a* in the nozzle row 31 of the ink jet head 30 by moving the ink jet head 30 in the main scanning direction shown by the arrow 10*a* even when the position of the detection region 40*b* is fixed in the sub scanning direction relative to the ink jet head 30. Accordingly, the ink jet printer 10 does not need to be provided with a mechanism for moving the light emitting section 41 or the light receiving section 42 in the sub scanning direction relative to the ink jet head 30, as a result of which structural complication can be suppressed.

Figure 16:
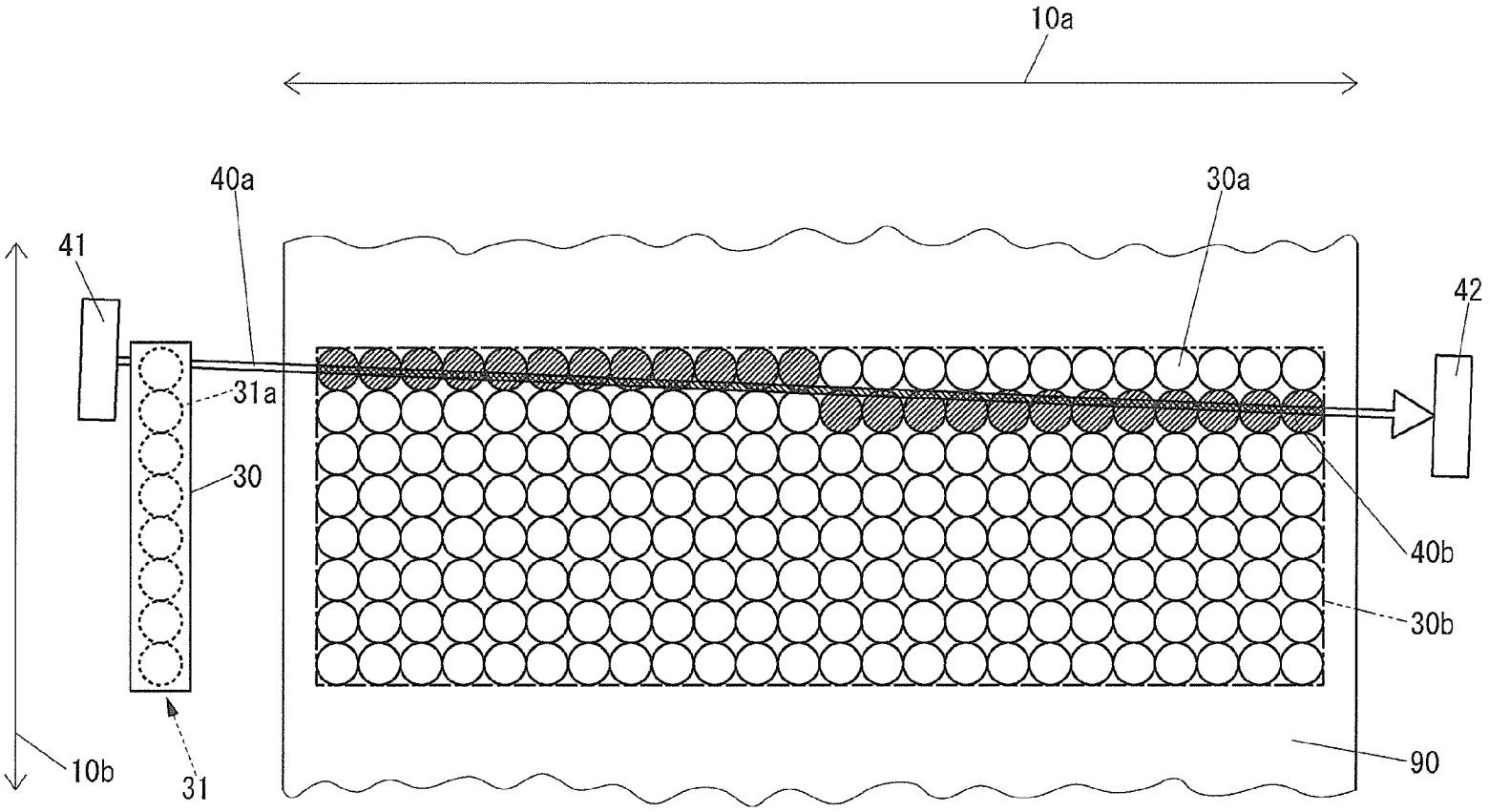
FIG. 16 is a diagram showing a relationship between a detection region and ink droplets in an example different from the examples shown in FIG. 5 and FIG. 14 of the ink jet printer shown in FIG. 1.

It should be noted that as shown in FIG. 16, for example, in the ink jet printer 10, the width of the detection region 40*b* in the sub scanning direction shown by the arrow 10*b* may be less than the width of the printable range 30*b*. In case of this configuration, the ink jet printer 10 can detect the defect for all of the nozzles 31*a* in the nozzle row 31 of the ink jet head 30 by, for example, being provided with the mechanism for moving the light emitting section 41 and the light receiving section 42 in the sub scanning direction.

Figure 17:
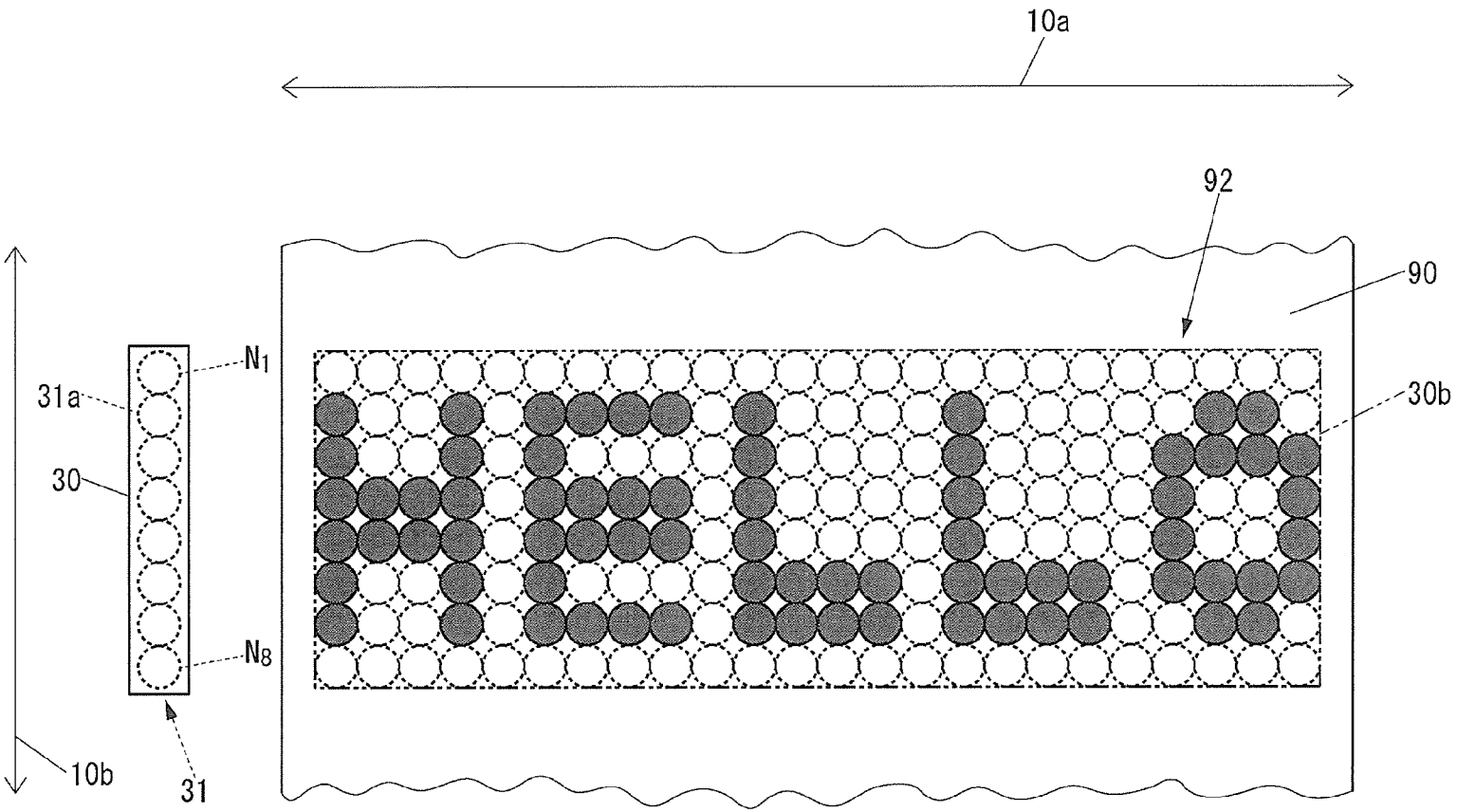
FIG. 17 is a diagram showing an example that is different from the example shown in FIG. 15 of the print target image of the ink jet printer shown in FIG. 1.
Figure 18A:
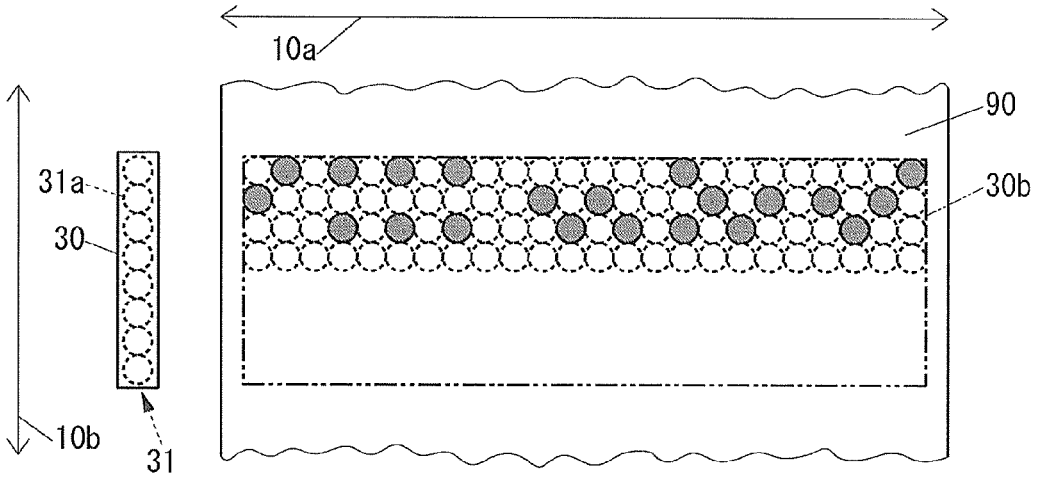
FIG. 18A is a diagram showing one step in multipath printing by the ink jet printer shown in FIG. 1.
Figure 18B:
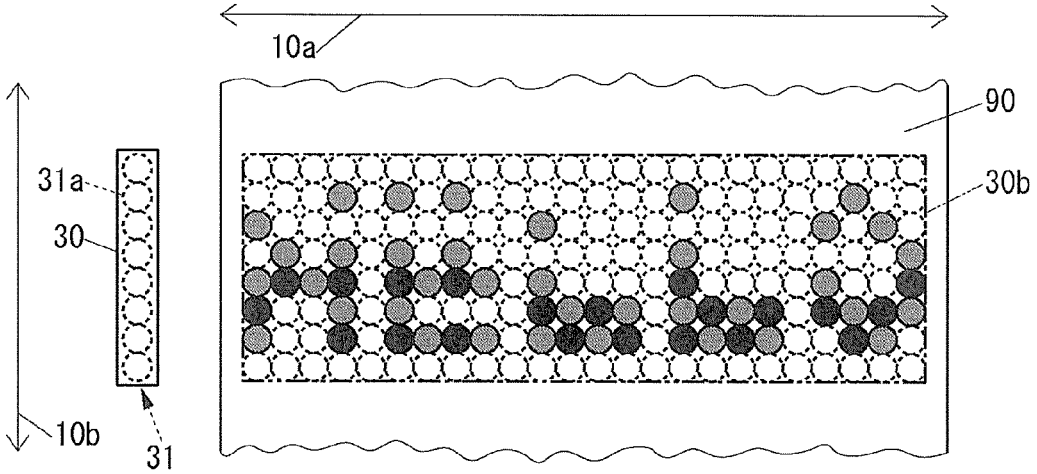
FIG. 18B is a diagram showing a step after the step shown in FIG. 18A.
Figure 18C:
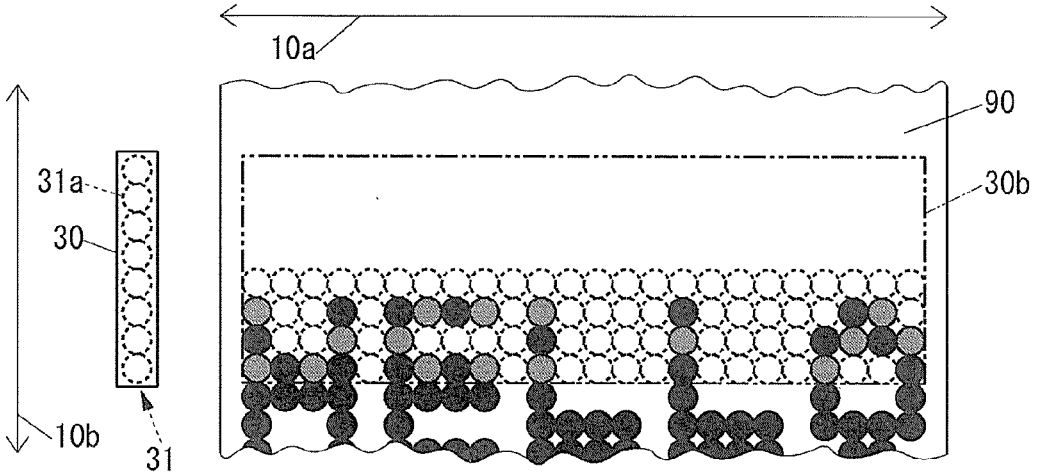
FIG. 18C is a diagram showing a step after the step shown in FIG. 18B.

The ink jet printer 10 may execute a multipath printing that prints a plurality of portions having a same position in the sub scanning direction shown by the arrow 10*b* and respectively different positions in the main scanning direction shown by the arrow 10*a* by a plurality of nozzles 31*a* having different positions in the sub scanning direction from each other in the ink jet head 30. Here, the description will be given based on a case where the print target image is an image 92 shown, for example, in FIG. 17. In FIG. 17, circles within the image 92 having the inner side colored in gray indicate portions where the ink droplets 30*a* are planned to be discharged, and white circles depicted by dotted outline in the image 92 indicate portions where the ink droplets 30*a* are not planned to be discharged. If the print target image is the image 92 shown in FIG. 17, in the ink jet printer 10, if the image 92 is to be printed by one main scan printing, defect cannot be detected even when it is generated in the nozzle $N_1$ and nozzle $N_8$, since there originally is no plan to discharge the ink droplets 30*a* in regions in the detection region 40*b* corresponding to the nozzle $N_1$ and nozzle $N_8$. However, in the ink jet printer 10, if the image 92 is to be printed by the multipath printing shown in FIG. 18, there is no nozzle 31*a* from which an ink droplet is not discharged even once to the detection region 40*b* during the printing of the image 92. It should be noted that in FIG. 18, the circles within the printable range 30*b* having the inner side colored in gray indicate portions where the ink droplets 30*a* are planned to be discharged when the position of the ink jet head 30 in the sub scanning direction relative to the print medium 90 is at the position shown in the drawings. Further, the white circles depicted by dotted outline in the printable range 30*b* indicate portions where the ink droplets 30*a* are not planned to be discharged when the position of the ink jet head 30 in the sub scanning direction relative to the print medium 90 is at the position shown in the drawings. Further, black circles indicate portions where the ink droplets 30*a* were discharged onto the print medium 90 by the main scan printing by the ink jet head 30 before the position of the ink jet head 30 relative to the print medium 90 in the sub scanning direction comes to be the position shown in the drawing. Accordingly, in executing the multipath printing, the ink jet printer 10 detects the defect for the same nozzle 31*a* at several positions in the sub scanning direction in the print target image, as compared to a configuration that prints a plurality of portions having the same position in the sub scanning direction and respectively different positions in the main scanning direction by the same nozzle 31*a* in the ink jet head 30. Therefore, the influence of contents of the print target image on the execution of the detection of the defective nozzle 31*a* can be reduced. Thus, the ink jet printer 10 can improve the detection accuracy of the defective nozzle 31*a*.

When the occasion where the ink droplets 30*a* were not detected occurs 10 times or more (YES in S166), the ink jet printer 10 detects the defective nozzle 31*a* (S167). However, it may be configured to detect the defective nozzle 31*a* in a case where the occasion occurs in excess of a number other than 10 times. For example, the ink jet printer 10 may be configured to detect the defective nozzle 31*a* in a case where the occasion where the ink droplets 30*a* were not detected occurs even once. However, if the ink jet printer 10 is configured to detect the defective nozzle 31*a* in the case where the occasion where the ink droplets 30*a* were not detected occurs over a plurality of times, the reliability of the detection of the defective nozzle 31*a* can be improved compared to the configuration that detects the defective nozzle 31*a* in the case where the occasion where the ink droplets 30*a* were not detected occurs even once.

It should be noted that the ink jet printer 10 has eight nozzles 31*a* formed in the ink jet head 30 in the present embodiment. However, nozzles 31*a* may be formed in a number other than eight. Further, the ink jet printer 10 has the printable range 30*b* configured of maximum of twenty-four ink droplets 30*a* in the main scanning direction shown by the arrow 10*a* in the present embodiment. However, it may be formed in a number of ink droplets 30*a* other than twenty four.

(Second Embodiment)

A configuration of an ink jet printer of a second embodiment of the present invention will be described.

It should be noted that among the configurations of the ink jet printer of the present embodiment, configurations identical to the configuration of the ink jet printer 10 of the first embodiment (see FIG. 1) will be given the same reference signs as the ink jet printer 10, and the detailed description thereof will be omitted.

Figure 19:
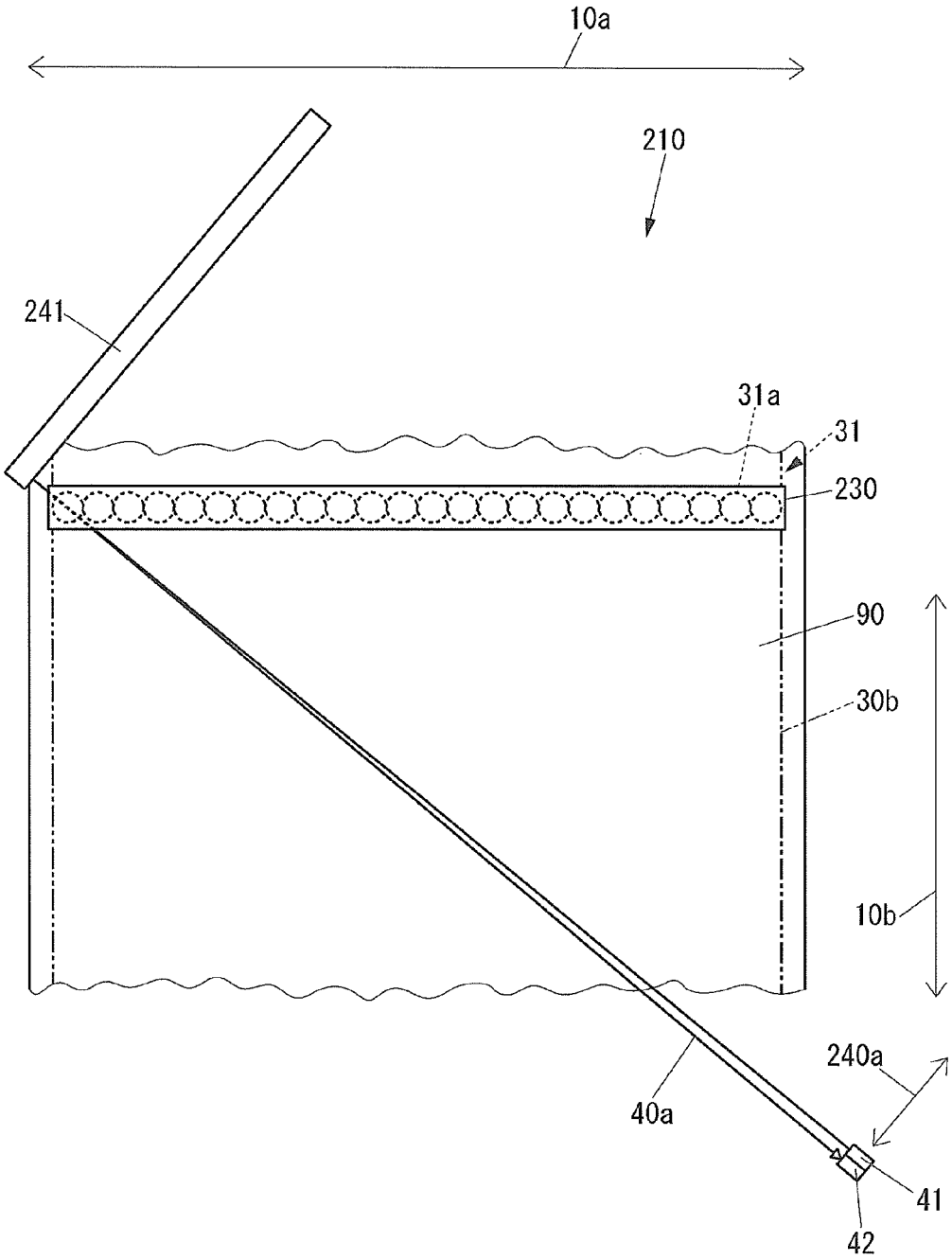
FIG. 19 is a plan view of an ink jet head, a light emitting section, and a light receiving section in an ink jet printer of a second embodiment of the present invention.

FIG. 19 is a plan diagram of an ink jet head 230, a light emitting section 41, and a light receiving section 42 of an ink jet printer 210 of the present embodiment.

As shown in FIG. 19, the configuration of the ink jet printer 210 is the same as a configuration in which the ink jet printer 10 includes the ink jet head 230 being a line head in which a nozzle row 31 extends in the same width as the width of the printable range 30*b* in the direction shown by the arrow 10*a* instead of the ink jet head 30 being the serial head (see FIG. 2), and further a mirror 241 is provided in the ink jet printer 10.

The mirror 241 is a component for reflecting the light 40*a* emitted by the light emitting section 41 and cause the same to reach the light receiving section 42.

In a case of the configuration shown in FIG. 19, the ink jet printer 210 can detect the defective nozzle 31*a* by the ink droplets 30*a* that were discharged during printing similar to the first embodiment by having a mechanism for moving the light emitting section 41 and the light receiving section 42 in a direction shown by an arrow 240*a*, whereby wasteful ink consumption can be suppressed.

Figure 20:
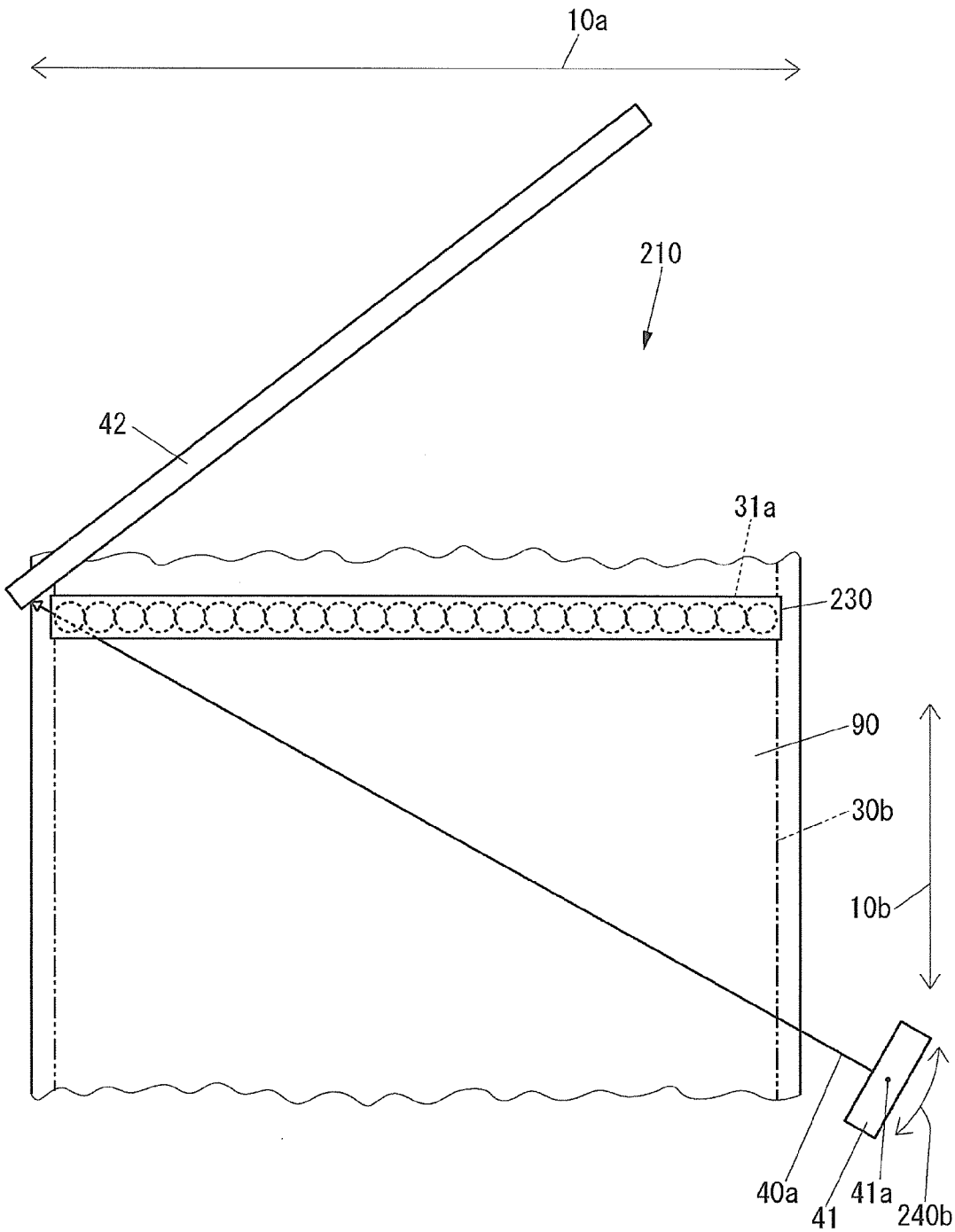
FIG. 20 is a plan view of an example different from the example shown in FIG. 19 of the ink jet head, the light emitting section, and the light receiving section in the ink jet printer of the second embodiment of the present invention.

The ink jet printer 210 may employ a path other than the one shown in FIG. 19 as a path of the light 40*a* from the light emitting section 41 to the light receiving section 42. For example, in a case of a configuration shown in FIG. 20, the ink jet printer 210 can detect defects in all of the nozzles 31*a* by a rotation in a direction shown by an arrow 240*b* with a point 41*a* of the light emitting section 41 as a center.

It should be noted that the ink jet printer 210 is configured with twenty-four nozzles 31*a* in the ink jet head 230 in the present embodiment. However, the nozzles 31*a* with a number other than twenty four may be formed.

The ink jet printer of the respective embodiments as described above is configured to move the ink jet head in the relative manner in the direction shown by the arrow 10*b* relative to the print medium 90 by transferring the print medium 90 in the direction shown by the arrow 10*b*. However, configurations other than the above may be employed. For example, the ink jet printer may be configured to move the ink jet head in the relative manner in the direction shown by the arrow 10*b* relative to the print medium 90 by moving the ink jet head in the direction shown by the arrow 10*b*.

What is claimed is:

1. An ink jet printer comprising:

an ink jet head in which a row of nozzles for discharging ink droplets toward a print medium is formed;

a light emitting section that emits light at an angle greater than 0° and less than 90° with respect to the row of nozzles for detecting the ink droplets that are flying and were discharged from the nozzles;

a light receiving section that receives the light emitted by the light emitting section;

a print executor that executes printing by the ink jet head based on print data;

an ink droplet detector that detects the ink droplets in a case where an amount of the light received by the light receiving section among the light emitted by the light emitting section is equal to or less than a predetermined amount; and a defective nozzle detector that detects a defective nozzle, wherein the defective nozzle detector determines a nozzle as being defective, in a case where an ink droplet discharged from the nozzle based on the print data in printing executed by the print executor is not detected by the ink droplet detector at a scheduled timing of passing through a detection region to be detected by the ink droplet detector, wherein determining the nozzle as being defective by the defective nozzle detector takes place during the ink jet head executing the printing based on the print data.

2. The ink jet printer according to claim 1, wherein:

the ink jet head is a serial head that is moved reciprocatingly in a main scanning direction and is moved in a relative manner in a sub scanning direction that perpendicularly intersects with the main scanning direction relative to the print medium; and a width of the detection region in the sub scanning direction is equal to or greater than a width of a printable range in the sub scanning direction, the printable range being a range that the ink jet head can print by moving only in the main scanning direction, not in the sub scanning direction.

3. The ink jet printer according to claim 2, wherein a width of the detection region in the main scanning direction is equal to or greater than a width of the printable range in the main scanning direction.

4. The ink jet printer according to claim 2, wherein the print executor executes a multipath printing that prints a plurality of portions having a same position in the sub scanning direction and respectively different positions in the main scanning direction by a plurality of the nozzles having respectively different positions in the sub scanning direction in the ink jet head.

5. The ink jet printer according to claim 3, wherein the print executor executes a multipath printing that prints a plurality of portions having a same position in the sub scanning direction and respectively different positions in the main scanning direction by a plurality of the nozzles having respectively different positions in the sub scanning direction in the ink jet head.

6. A method for detecting a defective nozzle of an ink jet printer, comprising:

during printing that is executed by a print executor based on print data that is transmitted from an outside of the ink jet printer, and for each print in a main scanning direction:

updating a planned discharge information based on the print data and a detection target position information;

in the case where an ink jet head is at a position where a discharge plan is "Present" in the planned discharge information, determining a nozzle associated in the detection target position information with the position where the ink jet head is present as a defective nozzle when an ink droplet discharged from the nozzle is not detected at a scheduled timing of passing through a detection region;

wherein the ink jet printer comprises:

a serial ink jet head, that is moved reciprocatingly in the main scanning direction and is moved in a relative manner in a sub scanning direction that perpendicularly intersects with the main scanning direction relative to a print medium, in which a row of nozzles for discharging ink droplets toward the print medium is formed;

a light emitting section that emits light at an angle greater than 0° and less than 90° with respect to the row of nozzles for detecting the ink droplets that are flying and were discharged from the nozzles;

a light receiving section that receives the light emitted by the light emitting section;

a print executor that executes printing by the ink jet head based on print data;

an ink droplet detector that detects the ink droplets in a case where an amount of the light received by the light receiving section among the light emitted by the light emitting section is equal to or less than a predetermined amount; and a defective nozzle detector that detects a defective nozzle.

7. The method for detecting a defective nozzle as claimed in claim 6, wherein:

a width of the detection region in the sub scanning direction is equal to or greater than a width of a printable range in the sub scanning direction, the printable range being a range that the ink jet head can print by moving only in the main scanning direction, not in the sub scanning direction.

8. The method for detecting a defective nozzle as claimed in claim 7, wherein a width of the detection region in the main scanning direction is equal to or greater than a width of the printable range in the main scanning direction.

9. The method for detecting a defective nozzle as claimed in claim 7, wherein the print executor executes a multipath printing that prints a plurality of portions having a same position in the sub scanning direction and respectively different positions in the main scanning direction by a plurality of the nozzles having respectively different positions in the sub scanning direction in the ink jet head.

10. The method for detecting a defective nozzle as claimed in claim 8, wherein the print executor executes a multipath printing that prints a plurality of portions having a same position in the sub scanning direction and respectively different positions in the main scanning direction by a plurality of the nozzles having respectively different positions in the sub scanning direction in the ink jet head.

* * * * *